United States Patent [19]

Mikusch et al.

[11] Patent Number: 4,557,133

[45] Date of Patent: Dec. 10, 1985

[54] PRESS UNIT HAVING GRIPPER RAILS TO BE EXCHANGED AT THE SAME TIME AS THE TOOLS

[75] Inventors: Gerald Mikusch; Werner Münch, both of Göppingen, Fed. Rep. of Germany

[73] Assignee: L. Schuler GmbH, Fed. Rep. of Germany

[21] Appl. No.: 533,453

[22] Filed: Sep. 19, 1983

[30] Foreign Application Priority Data

Sep. 24, 1982 [DE] Fed. Rep. of Germany ..... 3235308

[51] Int. Cl.[4] ..... B21J 13/08; B21D 43/10

[52] U.S. Cl. ..... 72/405; 72/422; 198/621; 403/340; 403/286

[58] Field of Search ..... 72/405, 422; 403/292, 403/364, 363, 311, 264, 340, 339, 341, 286; 198/621, 774

[56] References Cited

U.S. PATENT DOCUMENTS

| | | | |
|---|---|---|---|
| 1,629,317 | 5/1927 | Smith | 403/363 |
| 2,755,115 | 7/1956 | Kollmann | 403/311 |
| 3,266,827 | 8/1966 | Whicker | 403/292 |
| 3,318,099 | 11/1967 | Sugden | 403/364 |
| 3,387,865 | 6/1968 | Ross | 403/292 |
| 4,124,317 | 11/1978 | Dauth | 403/264 |
| 4,259,052 | 3/1981 | Imanishi et al. | 72/405 |
| 4,286,642 | 9/1981 | Keatley | 29/453 |

FOREIGN PATENT DOCUMENTS

| | | | |
|---|---|---|---|
| 116451 | 3/1969 | Norway | 403/292 |
| 1101838 | 1/1968 | United Kingdom . | |
| 1321846 | 7/1973 | United Kingdom | 72/405 |
| 614219 | 7/1978 | U.S.S.R. | 403/311 |

*Primary Examiner*—Daniel C. Crane

*Attorney, Agent, or Firm*—Craig and Burns

[57] ABSTRACT

A press unit having gripper rails to be exchanged at the same time as the tools, wherein in hollow spaces of the ends of the gripper rails, means are inserted for the locking of the form-fitting or toothed connection of gripper rails on the side of the press and gripper rails on the side of the tool that are to be connected with one another for the transfer of workpieces. The device comprises a control element, a pressing rod that can be acted upon by the control element, and a locking member connected to said pressing rod, with said locking member being slidable in a preferably press side end of the gripper rails and a mating piece for receiving the locking member during the form-locking or toothed connection of the ends of the gripper rails and being slidable in an end at the side of the tool.

5 Claims, 6 Drawing Figures

Fig. 2
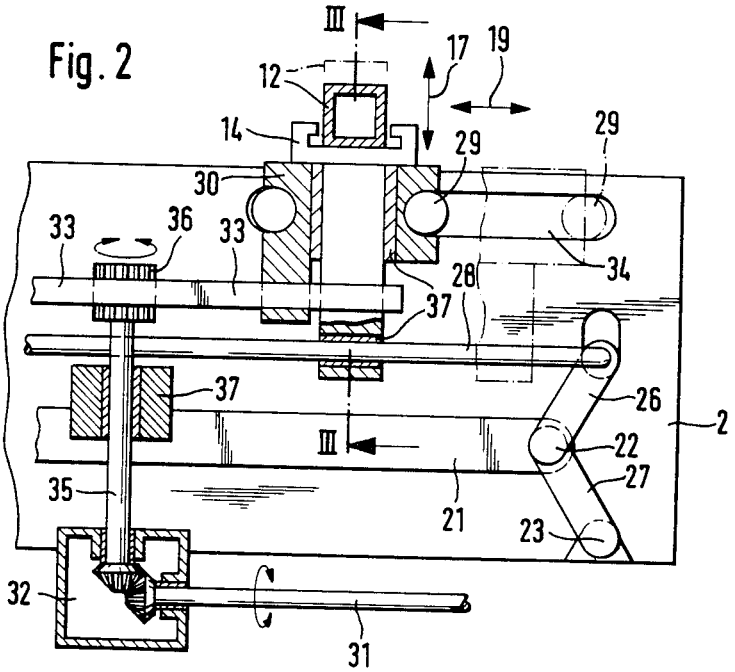
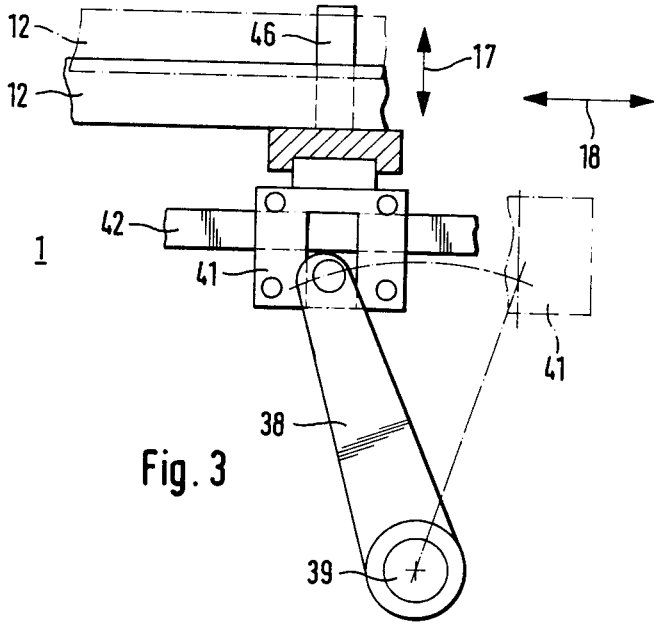
Fig. 3

PRESS UNIT HAVING GRIPPER RAILS TO BE EXCHANGED AT THE SAME TIME AS THE TOOLS

This invention relates to press units having gripper rails to be exchanged at the same time as the tools.

A press unit may have a multiple die or a similar press having a plurality of tools and at least one platen and a sliding table that can be locked at the platen in working position for the tool chains, gripper rails on the side of the press frame that can be adjusted with the movement of the slide and further gripper rails on the side of the tool for the conveyance of the workpiece from one treatment step to the next which by means of guided movement, one rail against the other, can be connected with one another in a form-locking manner and can be disconnected from one another. A drivable control element is provided for locking the connection by way of a locking member during the operation of the press.

In their dimensions and settings, the gripping devices or pliers are matched with the respective workpiece to be gripped and can thus be assigned directly to the tool or the set of tools on a press unit. In order to reduce tool changing times and to avoid the changes of the gripping devices or pliers required during these periods, the gripper rails are exchanged at the same time as the tool or the tool set for gripping devices or pliers and gripper rails adjusted to the new workpiece. For this purpose, the gripper rails must be disconnected from the driving mechanism.

A known device for the firm form-fitting connection of linkages in tool holding devices is shown in GP-PS No. 1 101 838. In this case, the ends to be connected of the rods were provided with claws interlocking in a form-fitting manner. A shell having a handle part is to be pushed over the connection, with said shell having to be guided against a stop, and thus holds the connection against unintentional separating. This text contains no reference to the automation of the opening and closing and of the securing of the connection; the connection must, in contrast, be established and disconnected manually. This arrangement can only be used to a limited extent in press units because the gripper rail linkages used there must be guided but the transfer movement of the gripper rails is so large that gripper rails having connections constructed in this manner cannot be used between the tool sets.

In DE-PS No. 19 64 326, a multiple die press is described having a conveying mechanism for the conveying of the workpieces from one treatment step to the next. The conveying movement is led off the slide drive. A sliding table that can be moved with respect to the pertaining platen is assigned to each press slide, with said sliding table carrying the bottom tool of at least one tool set. The conveying mechanism assigned to one tool set or the tool sets can be disconnected above the bottom from the drive on the side of the slide and can be exchanged together with the tool set or the tool sets.

The idea according to the device shown in GB-PS No. 1 101 838 also was not picked up in DE-OS No. 29 00 526. Among other things, this text shows a transfer unit for moving the gripper rails forward and backward.

The gripper rails are divided into gripper rails on the side of the tool that can be exchanged at the same time as the tool, and gripper rails on the side of the press frame that remain in the press assembly. Via a pin-hole connection, the gripper rail parts can be connected with one another in a form-locking manner. The connection can be repeatedly disconnected and connected by the lifting and lowering of a plate carrying the tools. In order to avoid that the gripper rails become detached from their mutual connection with one another, when the rods are moved very rapidly, an oil pressure cylinder having a piston is disposed at the gripper rail on the side of the frame, with said piston, when acted upon, affecting a rubber-elastic member which, under pressure, places itself against the perforated edge of the perforation, on the side of the tool, of the form-locking connection. The construction of the securing device is accessible from all sides and is thus exposed to the rough operational conditions. The projecting structural elements prevent the use of this device between the tool sets or tools within the press.

The invention can be used in the case of a workpiece conveying system having gripping devices or pliers that are mounted on two gripper rails, in pairs disposed opposite one another and are applied jointly to the workpiece, as well as for gripper rails having one gripping device or plier each per workpiece access and especially also for gripping devices or pliers, that can be activated, on a gripper rail with vertical gripper access.

An object of the invention is the automation of the changing process of the gripper rails at the same time as the changing process of the tools. The resulting system can be retrofitted and can be used in presses that do not lift the tool sets at the time of a tool change as well as in presses that lift the tool sets and lift the gripper rails, for the purpose of changing them.

Another object of the invention is the provision of an improved press unit comprising locking means arranged within hollow spaces of gripper rails comprising a control element for the locking and detaching movements, a shaped piece is housed in the gripper rails on the side of the press frame and a counter-shaped piece housed in a corresponding gripper rail on the side of the tool, of which at least one can be slid by means of a control element for the engagement into the fixed shaped piece during the form-fitting connection of the matching of gripper rails.

Another object of the invention is the provision of an enclosed construction which is space-saving, creating a long-term, operationally reliable and maintenance-free arrangement and makes it possible to apply the control elements, for the connecting and disconnecting of the form-locking connection, in the area of the connection.

Another object of the invention is the provision of a press unit wherein already existing lifting means may be used for the lifting of the sliding table, the tools or the gripper rails.

Another object of the invention is the provision of a press unit wherein control elements and slidable shaped pieces are housed in parts of the gripper rails on the side of the press frame, thereby reducing the number of control elements to double the number of interfaces.

According to another object of the invention, a press unit is provided wherein each control element and a shaped piece that can be slid with it longitudinally are housed in the longitudinal range of gripper rails so that pre-existing hollow spaces in the gripper rails are utilized optimally.

These and other objects, features, and advantages of the present invention will become more apparent from the following description when taken in connection with the accompanying drawings which show, for the purposes of illustration only, plural embodiments in accordance with the present invention, and wherein:

FIGS. 2 and 3 show partial views of the means for the conveying of the workpiece;

Figure 1:
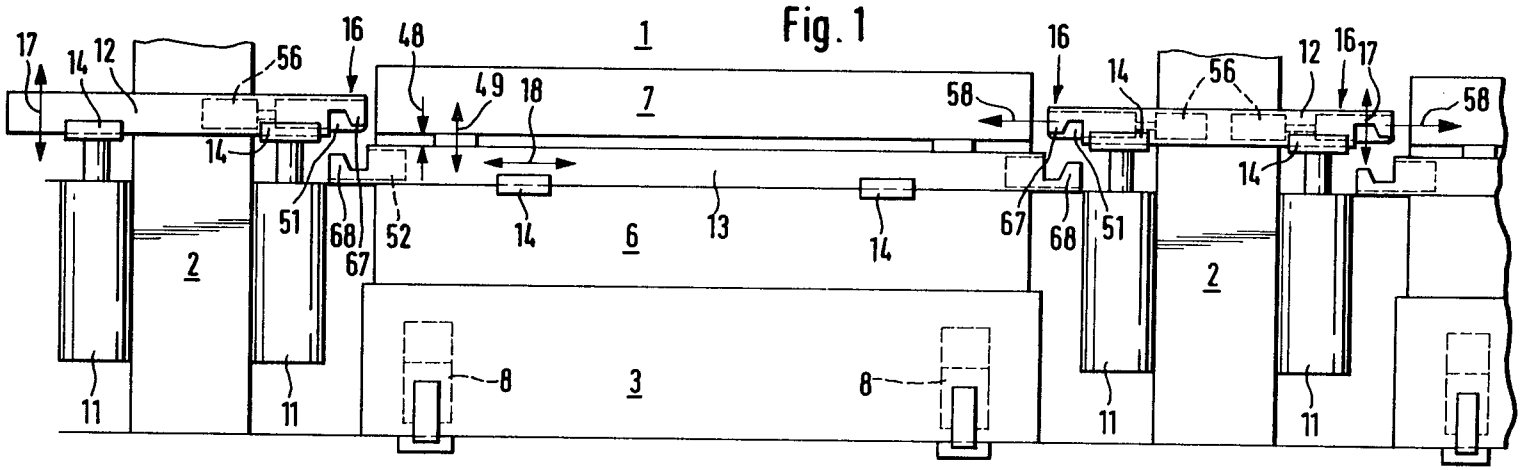
FIG. 1 shows a cut of a press in the tool area having an arrangement according to the invention.

Referring now to the drawings wherein like reference numerals are used throughout the various views to designate like parts and, more particularly, to FIG. 1, an area of a press has the reference number 1 that generally is called the working area of a press and where a number of lower and upper tool parts 6, 7 are arranged, with the press stands 2, a sliding table 3 that can be locked at the platen, with said sliding table 3 here shown as hiding the platen, and with tools consisting of upper tool parts 7 and lower tool parts 6 which are aligned at the sliding table or tables 3 and can be moved out of the working area together with the sliding table or sliding tables 3. Lifting cylinders for the lifting and lowering of the sliding table 3 have the reference number 8. The invention may also be used when the sliding table 3 cannot be lifted for moving.

For the conveying of workpieces between the treatment steps of a press line or a multiple die press, gripper rails 12, 13 are used which, in pairs, for example, for horizontal workpiece access but may also be present individually, for example, for vertical workpiece access. In the area of the disconnecting or separating locations having the reference number 16, the gripper rails can be distinguished as gripper rails 12 disposed on the side of the press and gripper rails 13 located on the side of the tool 6.

Figure 5:
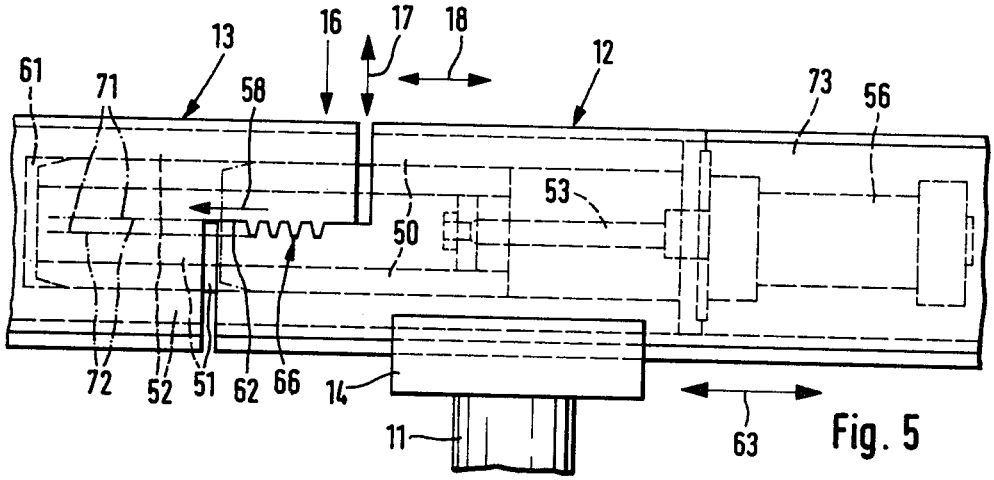
FIG. 5 shows another embodiment of the ends of the gripper rails that are connected with one another in a form-locking manner and are arrested according to the invention.

In slideways 14, the gripper rails can be adjusted in the direction of the transfer movement and in the gripping, lifting and lowering movement. Lifting cylinders 11 are used for the lifting and lowering of the workpieces in the treatment steps. By means of said lifting cylinders 11 as well as by means of the lifting cylinders 8 of the sliding tables, a lifting of the gripper rails 12 out of the gripper rails 13, as shown in FIG. 1 or a lifting of the gripper rails 13 out of the gripper rails 12, as shown in FIG. 5, can take place. The lifting direction during the workpiece transfer is indicated by the double arrow 17; the transfer direction is indicated by the double arrow 18. The gripping movement according to FIG. 1 takes place in the plane of the drawing and in FIG. 2 has the reference number 19.

Figure 6:
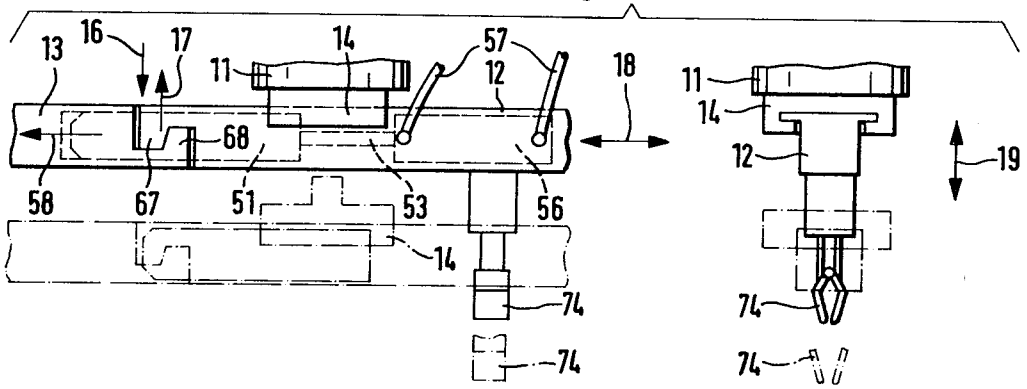
FIG. 6 shows another embodiment according to the invention having a gripping device with vertical access.
Figure 4:
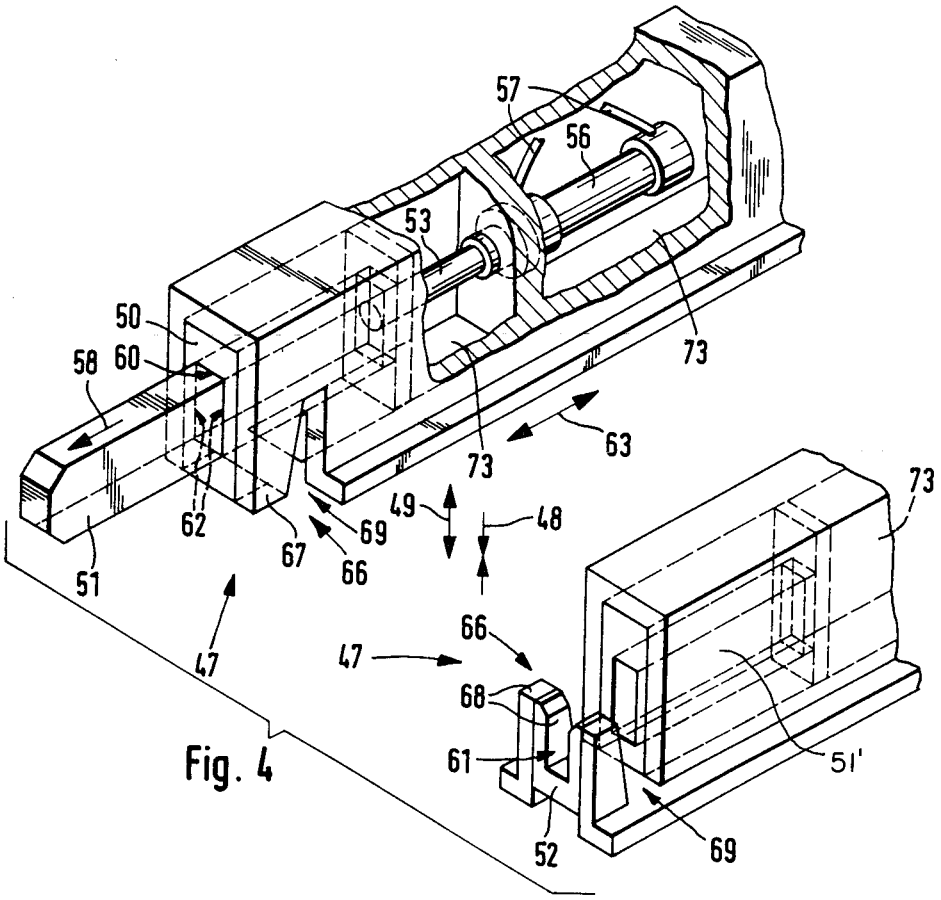
FIG. 4 shows the ends of the gripper rails that are to be connected with one another according to the invention, in perspective view.

In one of the connectable and detachable ends of the gripper rail, as shown in FIGS. 4, 5 and 6, and having the reference number 47 in FIG. 4, a locking member 51 is disposed in a reinforcing piece 50 so that it can be slid in the direction of the arrow 58, as well as a control member 56 which, by means of a pressing rod 53 is tied to the locking member 51. In the other pertaining end of the gripper rail, a mating piece 52 is firmly installed for receiving the locking member which, in the connected condition, can be inserted in its recess 61. The control member 56 may be a double-acting hydraulic cylinder piston which, via the flexible tubes 57, can be operated in the manner of an opening-closing movement for the locking member. The locking member 51 is guided in the recess 60 of the reinforcing piece and essentially in the front area 62. The arrangement of the control member 56, the pressing rod 53 and the locking member 51 in one end of the gripper rail, which preferably should be assigned to the part 12 of the gripper rail on the side of the press, as well as the mating piece 52 in the other end of the gripper rail extends in the hollow spaces 73 at 51' of the gripper rails that may, for example, be rectangular or square, in their longitudinal range according to arrow 63. For a firm connection in transfer direction 18, FIG. 1, the ends of the gripper rails have teeth 66, for example, a development similar to a one-tooth arrangement having a projection or tooth 67 and 68 with the recesses 69 for receiving the tooth of the end of the gripper rail to be connected.

The operation of the control member 56, the pressing rod 53, the locking member 51 and the mating piece results in securing of the connection of the ends of the gripper rails. For a tool change, the locking member, because of the automatically occurring control, is first returned from the recess 61 of the mating piece 52 so that the gripper rail 12 on the side of the press, via the lifting cylinder or cylinders 8, 11 is guided out of the engagement with the gripper rail on the side of the tool. The lift of the gripper rail 12 on the side of the press must be increased by the lift of the sliding table 3, when said sliding table 3 must be lifted via the lifting cylinders for the extraction of the tools.

FIG. 4 permits a view of the ends of the gripper rails to be connected. For a better view into the hollow space 73 of the upper end of the gripper rail, which may, for example, be the end of the gripper rail on the side of the press, the linkage is shown in an exploded view. The end of the gripper rail to be disconnected that is shown below in FIG. 4 has been turned by 180° in the horizontal plane for a better view of the recess side 61. The ends of the gripper rails may be connected and disconnected in the direction of the double arrows 48 and 49, therefore, in the direction of the lift 17 of the transfer movement, in which case the shown toothing mates in a form-locking manner.

FIG. 5 shows another development of the ends of the gripper rails. Several teeth in the form of toothed racks 66 are mounted at each gripper rail having the dedendum and addendum surfaces shown as lines 71, 72 extending perpendicularly to the disconnecitng movement 49 shown in FIG. 4 or to the lifting directions 17. Locking, in the connected condition, is effected by the locking member 51 guided in direction 58.

In a partial front view and a partial side view, FIG. 6 shows a gripper rail having a part 13 on the press side for a vertical feed motion 19 of a, for example, active pair of gripping devices or pliers 74. The gripper rail 13 remaining at the tool during the tool change can be disconnected and connected from the gripper rail 12 on the side of the frame by the lifting of the gripper rail 12 on the side of the frame, as shown in FIG. 6, or, when the arrangement is opposite, by the lowering of the toothing 67, 68, forming the form-locking. The dash-dotted representation shows the position of the gripping devices or pliers 74 in the case of the workpiece removal or the depositing of the workpiece from or in the tool.

During the tool change, for example, by means of sliding tables, the whole transfer mechanism can be switched off by means of a so-called compound circuit.

The compound circuit has the effect that, when a circuit element is actuated, a command is given simultaneously, for example, to the valve for the longitudinal movement of the grippers—in this case, the gripper rails remain in the advanced-end position; to the valve for the transverse movement of the grippers—in this case, the gripper rails open or remain in the open position; and to the valve for the lifting and lowering movement so that the gripper rails are guided into a lowered position or remain in this position.

FIGS. 2 and 3 have the purpose of clarifying the movements of the gripper rails during the transfer.

FIG. 2 shows, how, via an adjusting rod 21 that in the linking point 22 is coupled with the articulated lever 27, the latter being swivelled in a fixed point 23 in the frame, and is coupled with the articulated lever 26. When the adjusting rod is adjusted in horizontal position, the link rod 28 is lifted which, via a plain bearing 37, acts upon the gripper rail 12 in the manner of a lifting movement, in the direction of the arrow 17. The opening and closing movement takes place via the drive rod 31, a bevel gearing 32, the pinion rod 35 with a change of motion between the pinion 36 and the two toothed racks 33, of which the toothed rack that is shown on the right here is firmly linked to the carriage 30 carrying the gripper rail via the guide 14. For this purpose, the carriage, via pilot pins 29, in a longitudinally movable manner, is arranged in an oblong hole 34 of a supporting plate of the frame 2.

FIG. 3 shows an exemplary embodiment for changing a rotating movement into the transfer movement 18 of the gripper rail 12 by means of a driving lever 38 that can be swivelled around the point of rotation 39 and a carriage 41 that can be adjusted in guides 42. The transfer movement 18 takes place vertically for the lifting and lowering and for the opening and closing movement 19.

While we have shown and described several embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A press unit comprising a multiple die having a plurality of tools and a sliding table comprising at least one platen that can be locked in working position, said sliding table being positioned adjacent a fixed press frame with said table being movable relative to said press frame for a tool change, first gripper rails mounted on the side of the press frame that can be adjusted in time with the movement of the sliding table, second gripper rails mounted on the side of the tool for engaging of the first gripper rails, means for connecting and disconnecting a first gripper rail with a second gripper rail in a form-locking manner comprising means for connecting the sliding table and platen by lifting and lowering said sliding table with respect to the platen for the tool change and comprising toothed means mounted on each of the first and second gripper rails on the side of the tool for establishing a connection between the sliding table and platen, at least one drive control element for the locking and unlocking of the connection via a locking means at least during the operation of the press, a control element, the locking means being arranged within hollow spaces in the longitudinal extent of both the first and second gripper rails and comprising at least one shaped piece housed prior to the connection in the first gripper rail on the side of the press frame, said at least one drive control element being positioned in the hollow spaces of said first gripper rail, and a mating piece housed in the second gripper rail on the side of the tool, of which one can be slid in the direction of the longitudinal extent of the gripper rails by means of the control element for locking of the connection of the matching gripper rails, a reinforcing means inserted into each end of at least one of the first and second gripper rails to be connected, said reinforcing means having a guide groove in the longitudinal extent of the first and second gripper rails for slidably receiving the shaped piece connected with the control element, and recesses vertically disposed with respect to the guide grooves in the end of at least one of the first and second gripper rails and in the reinforcing means, with the at least one shaped piece and the at least one mating piece complementing one another for the established connection of the first and second gripper rails

2. A press unit according to claim 1, wherein the toothed means comprises at the ends to be connected of at least one of said first and second gripper rails, at least one tooth and one mating tooth provided in the longitudinal extent of said gripper rails for form-fitting connection in the direction of the longitudinal extent of the said gripper rails with addendum and dedendum surfaces extending substantially perpendicularly to the direction of the connecting movement guiding the said gripper rails against one another.

3. A press unit according to claim 1, wherein the shaped piece is disposed at the end of at least one of said gripper rails so that it can be slid until it disengages one of said gripper rails and guidable by means of a central recess within a gripper rail to allow engagement of at least one tooth on each of said first and second gripper rails to be connected.

4. A press unit according to claim 2, wherein the toothed means comprise means mounted at the ends of the first gripper rails on the side of the press frame for engagement in the direction of the connecting movement.

5. A press unit comprising a multiple die press having a plurality of tools and one sliding table comprising at least one platen that can be fixed in operating position, said sliding table being positioned adjacent fixed press stands with said table being movable relative to said press stands for a tool change and gripper bars that can be adjusted in time with the slide movement for the transfer of workpieces from one processing station to the next comprising first gripper bar sections mounted on the press stands and second gripper bar sections mounted on the sliding table and being movable vertically away from the first gripper bars by means of the sliding table, coupling means for coupling and uncoupling the first and second gripper bar sections one from another by means of a movement taking place vertically, a drive control means comprising a fixing member for locking the coupling means at least during the operation of the press and for unlocking the coupling means for a tool change, the drive control means and the fixing member to be moved by the drive control means being inserted inside a hollow space of the first gripper bar section mounted on the press stand, the longitudinal dimensions of the drive control means and fixing member being disposed in a longitudinal position of the first gripper bar section, a counter part positioned in a hollow space of the second gripper bar section movable with the sliding table and the fixing member in response to the drive control means positioned into the hollow space of the first gripper bar section mounted on the press stand after the coupling of the first and second gripper bar sections can be slid into the counter part and before the uncoupling of the first and second gripper bar sections by means of the drive control means can be removed from the counter part.

* * * * *